United States Patent [19]

Beynet et al.

[11] 4,444,275

[45] Apr. 24, 1984

[54] CAROUSEL FOR VERTICALLY MOORED PLATFORM

[75] Inventors: Pierre A. Beynet, Tulsa, Okla.; Johnce E. Hall, Kingwood, Tex.

[73] Assignee: Standard Oil Company, Chicago, Ill.

[21] Appl. No.: 326,967

[22] Filed: Dec. 2, 1981

[51] Int. Cl.[3] ..... E21B 15/02

[52] U.S. Cl. ..... 175/7; 405/195; 166/339; 166/341

[58] Field of Search ..... 175/7; 166/339, 338, 166/341, 342, 353, 366, 368, 349; 405/195; 211/60 S

[56] References Cited

U.S. PATENT DOCUMENTS

| | | | |
|---|---|---|---|
| 4,174,011 | 11/1979 | Zaremba | 166/341 |
| 4,286,665 | 9/1981 | Walker | 175/7 |
| 4,317,488 | 3/1982 | Shotbolt | 166/366 |

*Primary Examiner*—James A. Leppink
*Assistant Examiner*—William P. Neuder
*Attorney, Agent, or Firm*—John D. Gassett

[57] ABSTRACT

This invention involves a modification of the prior art subsea drilling system in which a carousel is positioned on a central post surrounded by a coaxial circular array of well slots and is adapted to be rotated by drill pipe through conventional means, from the floating platform. The carousel utilizes a fixed support platform spaced from the axis of rotation a distance equal to the radius of the array of well slots. The platform has its own well slot and a bearing concentric with the well slot. A well slot platform, or support post platform, is journaled in this bearing and supports a plurality of guide posts on a circle centered at the axis of the well slot. The support posts support cables hanging from the drilling vessel, which are used to guide the drill bit down from the surface to the carousel well slot. The carousel is adapted to revolve while supported by circular rails concentric with the central guide post. Means are provided, such as two gears of equal diameter, one fixed to the template concentric with the turning post, the other fixed to the well slot platform, with an intervening pinion so that as the carousel revolves in one direction by a selected angle, the well slot platform and support rods will rotate through an equal angle with respect to the carousel, in the reverse direction. Thus the guide posts and guide cables will always remain with the same azimuth as that of the drill ship. In this way the twisting and tangling of the support cables is avoided.

8 Claims, 7 Drawing Figures

CAROUSEL FOR VERTICALLY MOORED PLATFORM

CROSS-REFERENCE TO RELATED APPLICATION

This invention is related to the U.S. patent of Zaremba, issued Nov. 13, 1979, as U.S. Pat. No. 4,174,011 and entitled: "SUBSEA DRILLING TEMPLATE WITH CAROUSEL GUIDANCE SYSTEM". This patent is assigned to the same assignee as this application.

BACKGROUND OF THE INVENTION

1. Field of the Invention

This invention lies in the field of drilling of off-shore wells.

More particularly, it concerns the drilling of multiple wells from a floating platform, such as the vertically moored platform, or an anchored drill ship, etc. It is involved with the provision of guide cables between the platform and the subsea carousel, whereby as the carousel is rotated to guide the drilling equipment into one or another of a plurality of well slots in the template, with the use of our invention the cables will always remain in the same azimuth as that of the drill ship.

2. Description of the Prior Art

The prior art is represented by the Zaremba U.S. Pat. No. 4,174,011 issued on Nov. 13, 1979, which shows the template structure on the sea floor with a plurality of groups of well slots specially arranged on the template, with means to position a carousel on a guide post in the center of a group of well slots so that it can be rotated successively to be over, and concentric with, each of the well slots. Cable guide means are provided between the carousel and the drill vessel which, under the prior art, would rotate with the carousel and would, therefore, twist with respect to the anchored drill ship or floating platform.

SUMMARY OF THE INVENTION

It is a primary object of this invention to provide an improved type of carousel for use in conjunction with a drilling template placed on the sea floor, which is used to guide the drilling apparatus from an anchored drilling vessel, or tethered platform, above the template.

It is a more specific object of this invention to provide a means of maintaining on a rotating carousel a constant azimuth for the well slot platform mounted on the carousel, which supports the bottom ends of guidance cables between the carousel and the drilling vessel.

These and other objects are realized and the limitations of the prior art are overcome in this invention by providing a carousel in which the well slot platform, to which is fastened the guide posts that are attached to the guidance cables from the surface, is permitted to rotate with respect to the carousel, and to provide some means by which, as the carousel rotates about the central support post, the well slot platform and support rods rotate with respect to the carousel structure in the opposite direction by an equal angle, thus the guide posts and cables will then maintain a constant azimuth with respect to the template and with respect to the drill ship, so as to avoid all tangling of the guidance cables as the carousel rotates.

In the prior art, the carousel is a rigid structure, supported at one end by a central tubular portion adapted to fit over the central support post of the template, which is at the axis of a circular array of well slots. By means of a tool lowered from the surface on drill pipe, the template can be rotated from one position, where its well slot is over one of the well slots of the template, to another position where it is coaxial with a different well slot of the template. It will be clear that if the guidance cables are attached rigidly to the carousel, as the carousel rotates, the pattern of cables will rotate with it, and there will be a twisting of the guidance cable between the drill ship and the carousel.

In this invention the carousel support platform is modified to provide a bearing concentric with its well slot. A well slot platform is supported in that bearing and can rotate with respect to the carousel. The well slot platform includes the well slot and a plurality of guide posts which are rigidly fastened to the platform. The guide posts are attached to the cables reaching to the surface.

In one embodiment two gears can be provided of the same diameter and the same number teeth. The diameter is somewhat less than the spacing between the axis of the support post and the well slots of the template. In the gap between the two gears is positioned a pinion which meshes with both gears, even though they may not be in the same horizontal plane.

One of these gears is fastened rigidly to the template and is coaxial with the central turning post, while the second gear is fastened to and is coaxial with the rotatable well slot platform. If the two gears are not coplanar, and not necessarily of the same diameter, then a long pinion can be used so that the plane of the two gears can be separated, or a short shaft can be journaled in the carousel with two pinions, one meshing with one gear and the other meshing with the second gear, the pinions' diameters such that the azimuth of the well slot platform stays constant.

By this means as the carousel is rotated with respect to the template the well slot platform that holds the support rods will maintain a constant azimuth with respect to the template and with respect to the tethered platform or anchored drill ship. Other embodiments are described in the Description of the Preferred Embodiments.

BRIEF DESCRIPTION OF THE DRAWINGS

These and other objects and advantages of this invention and a better understanding of the principles and details of the invention will be evident from the following description and claims, taken in conjunction with the appended drawings, in which:

DESCRIPTION OF THE PREFERRED EMBODIMENTS

Figure 1:
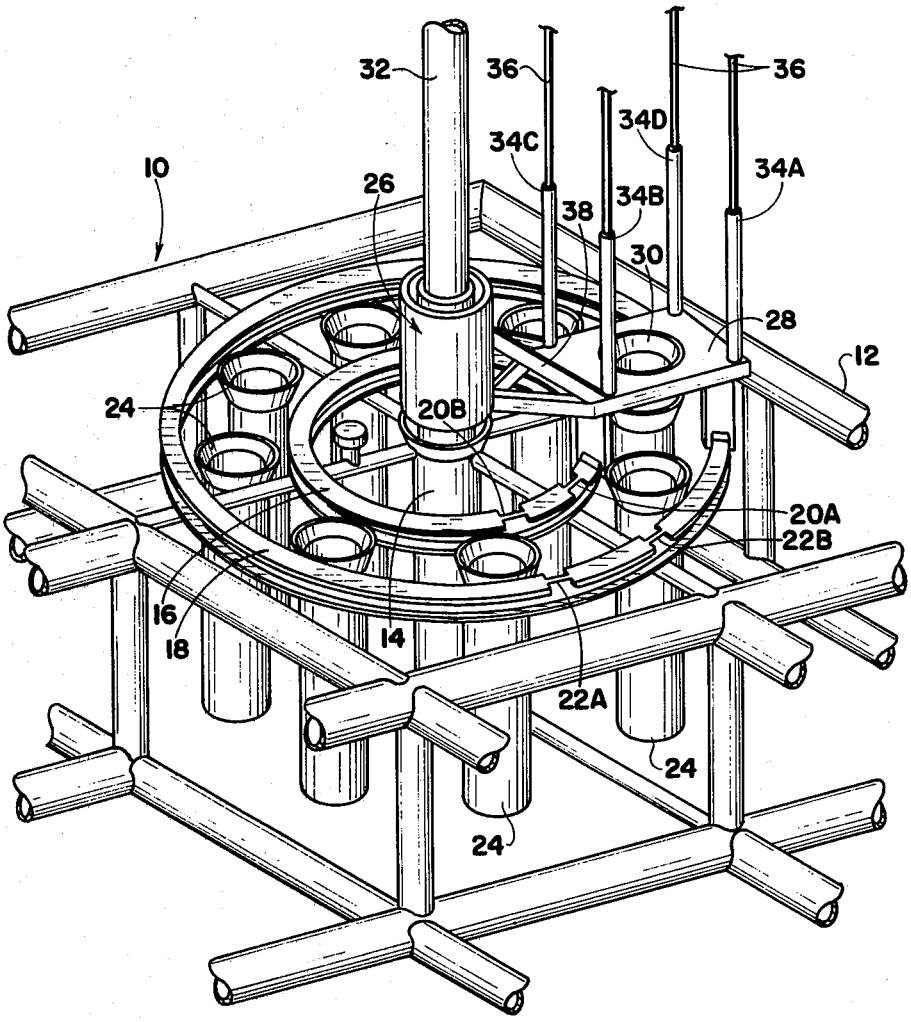
Fig. 1 (PRIOR ART)
FIG. 1 is a prior art drawing which forms a part of the U.S. Pat. No. 4,174,011, which is entered by reference into this application.
Figure 3:
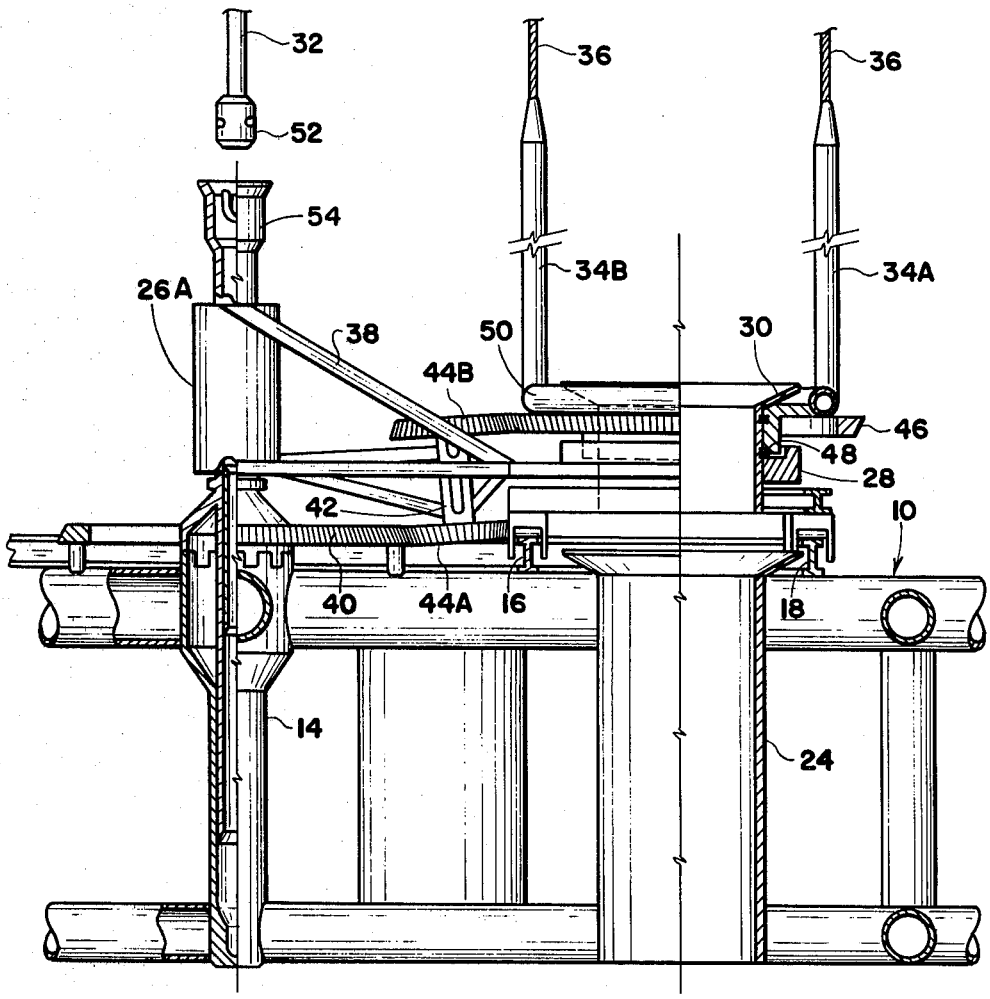
FIG. 3 is a vertical section of the carousel of this invention.

Referring now to the drawings and in particular to FIG. 1, there is shown a copy of FIG. 3 of the Zaremba patent for the purpose of illustrating the prior art. As is fully described in the patent, there is a carousel guide frame 10, more commonly called template, made of structural steel members 12, which contain a plurality of well slots 24 arranged in clusters such as, for example, in each corner of a square template, so that by positioning a drilling system on the deck of the drill vessel or the platform, drilling rods and bits, etc., can be lowered from the vessel into one or another of a plurality of well slots 24, so as to carry out a complete drilling process in each of a large plurality of spaced positions determined by the well slots.

A carousel, or rotating structure 26 revolves about a central turning post 14 includes, a support structure 38 and a carousel support platform 28, which has a short well slot 30. By rotating the carousel 26, this well slot 30 can be positioned over and coaxial with any one of the well slots 24.

On the platform 28 are a plurality of guide posts 34A, 34B, 34C and 34D which are arranged on a circle concentric with the well slot 30. Each of these guide posts are attached to cables 36, which are guidance cables, and are supported at the drill ship. As the drill bit and drill string are lowered from the ship to the template, the bit will be guided by the cables 36 directly to the well slot 30 and, of course, into the corresponding well slot 24.

One of the weaknesses of this design is that as the carousel structure 26 rotates about the tracks 16 and 18, the platform 28 rotates with respect to the template and with respect to the vessel. As the template is rotated it becomes necessary then to remove and reattach the upper ends of the cables to different winches, so that the cables will remain straight and parallel without any twisting action.

This is rather time consuming and troublesome and, of course, causes expensive delay. It is a severe weakness of the design of the carousel shown in FIG. 1.

Figure 2:
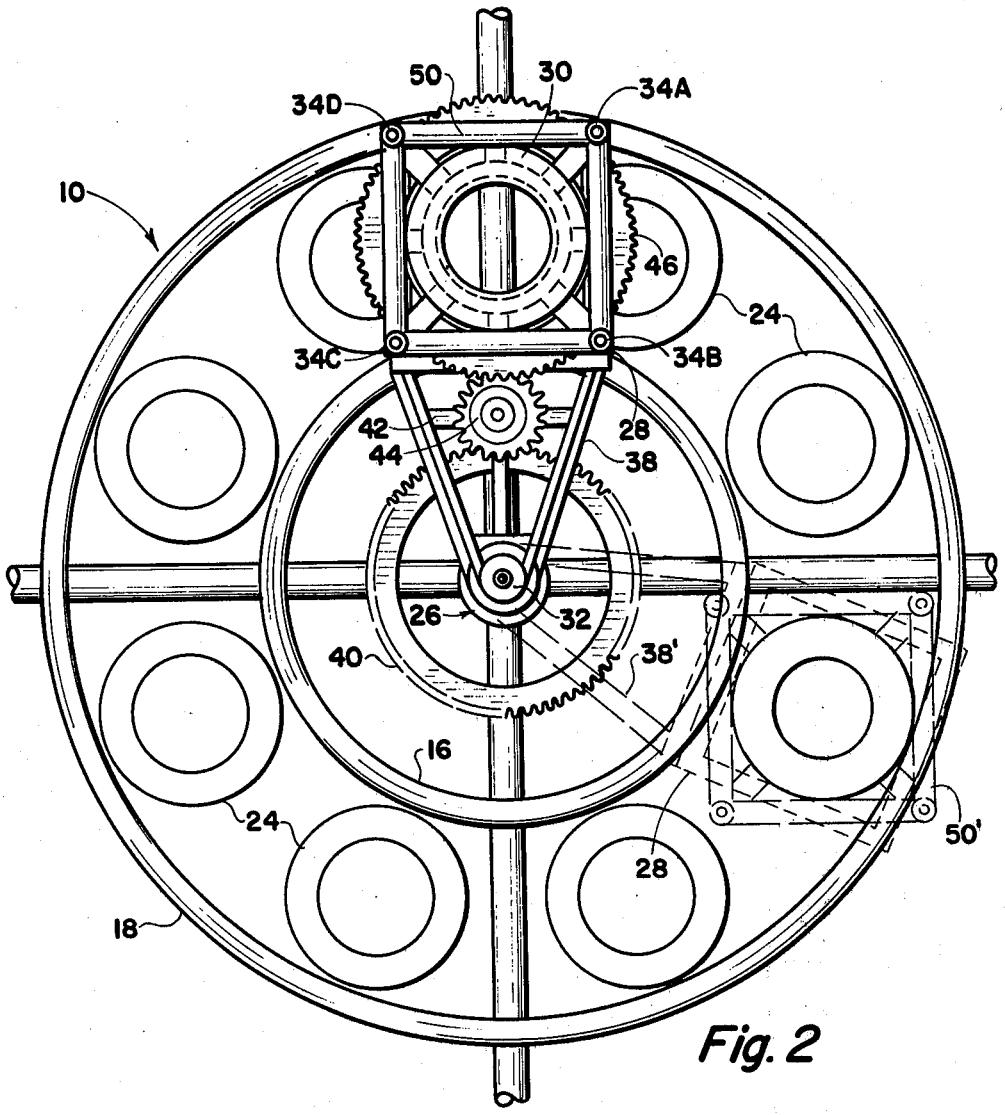
FIG. 2 is a modification of the carousel structure of FIG. 1 shown in plan view.

Referring now to FIGS. 2 and 3, there are shown plan and elevation views of a modified carousel structure 26. The principal modification is that the carousel structure 26, while having a fixed support platform 28, also has a second rotating well slot platform 50. This is supported in bearings 48 in the support platform 28, so that as the carousel structure 26 revolves, and even though the fixed platform 28 also revolves, it is possible to control the orientation of the well slot platform 50, by a means which is part of this invention.

The guide posts 34 are shown attached to a platform 50 illustrated as being square and having a guide post 34 at each of its four corners. In this respect it is similar to FIG. 1, however, the capability of orientation makes it entirely different so far as tangling of the guidance cables 36 is concerned.

One method of carrying out this control of orientation of the well slot platform 50 is to provide two gears 40 and 46 which can conveniently be of equal diameter. Their diameters are equal but are somewhat smaller than the spacing between the axis of the central post 14 and the well slots 24. In the space between the two gears there is provided a short shaft in a bearing 42 which is part of the structure 38 of the carousel. This shaft carries a pinion on top 44B and bottom 44A of equal diameters. The special layout is shown clearly in FIG. 2.

It will be clear from this description that as the carousel structure 38 revolves about 14 to position 38', the platform 28 will move with it. However, because of the interaction of the pinion 44 and the outer gear 46, the well slot plaform 50 will maintain a constant azimuth 50'. Therefore, as the carousel is revolved in any direction, by any angle, there will be no change in azimuth of the guide post platform 50, although there will be some displacement as it is moved into alignment with the different well slots 24. This displacement is no problem, since it is small compared to the distance from the surface of the water to the platform and the flexibility of the drill rod and the guidance cables will permit that degree of displacement.

Figure 4:
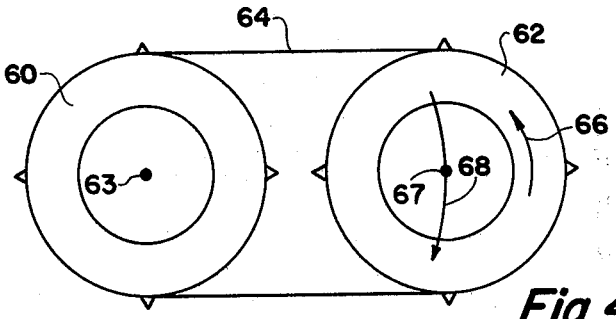
FIG. 4 illustrates another embodiment of the FIGS. 2 and 3.

While we have shown a gear arrangement tying the orientation of the well slot platform 50 to that of the template 10, there are also other ways of doing this. One, for example, is shown in FIG. 4. Here to chain sprockets 60, 62 are used, one of which 60 is attached rigidly to the template 10, and the other 62 which is attached to the well slot platform 50 (as is the gear 46 shown in FIGS. 2 and 3). A chain 64 encircles the two sprockets.

As the sprocket 62 is moved in a circle in accordance with the arrow 68 around the axis 63, as would be the case when the carousel is revolved about the central turning post 14, the sprocket 62 will rotate in an opposite direction about axis 67 in accordance with arrow 66, with respect to the carousel and, therefore, will maintain a constant azimuth, irrespective of the amount of rotation of the carousel.

What has been described so far is an improved carousel for use in drilling deep boreholes from a floating platform in deep water. The embodiment of FIGS. 2, 3 and 4 illustrates an important improvement which permits moving the drill pipe from one to another of the well slots without entangling the plurality of guide cables which are attached to the guide posts of the carousel. These cables are utilized for guiding the drill pipe down from the surface to the carousel and into the well slot which is being drilled.

In moving from one well slot to another, the structure 26A is rotated as shown in FIG. 3 by means of a fixture 52 which is lowered on drill pipe 32 and locks into a seat 54 which is part of the rotating carousel. The carousel has a cylindrical portion 26A which is journaled about a central post 14 at the center of the grouping of well slots. Thus by lowering the fixture 52 into the receptacle 54 and turning the drill pipe 32 the carousel can be made to revolve about the central post 14.

If the amount of rotation of the carousel structure 26 is never more than 180° on either side of a zero, or initial position, the guide cables 36 are always free and clear and are maintained in a given orientation with respect to the floating platform.

However, if the carousel structure 26A is rotated by more than 180° then the guide cables 36 will become wrapped around the drill pipe 32 when used as shown in FIG. 3. This provides difficulty in removing the drill pipe and fixture 52 from the socket 54 so that it can be lifted to the surface.

Figure 5:
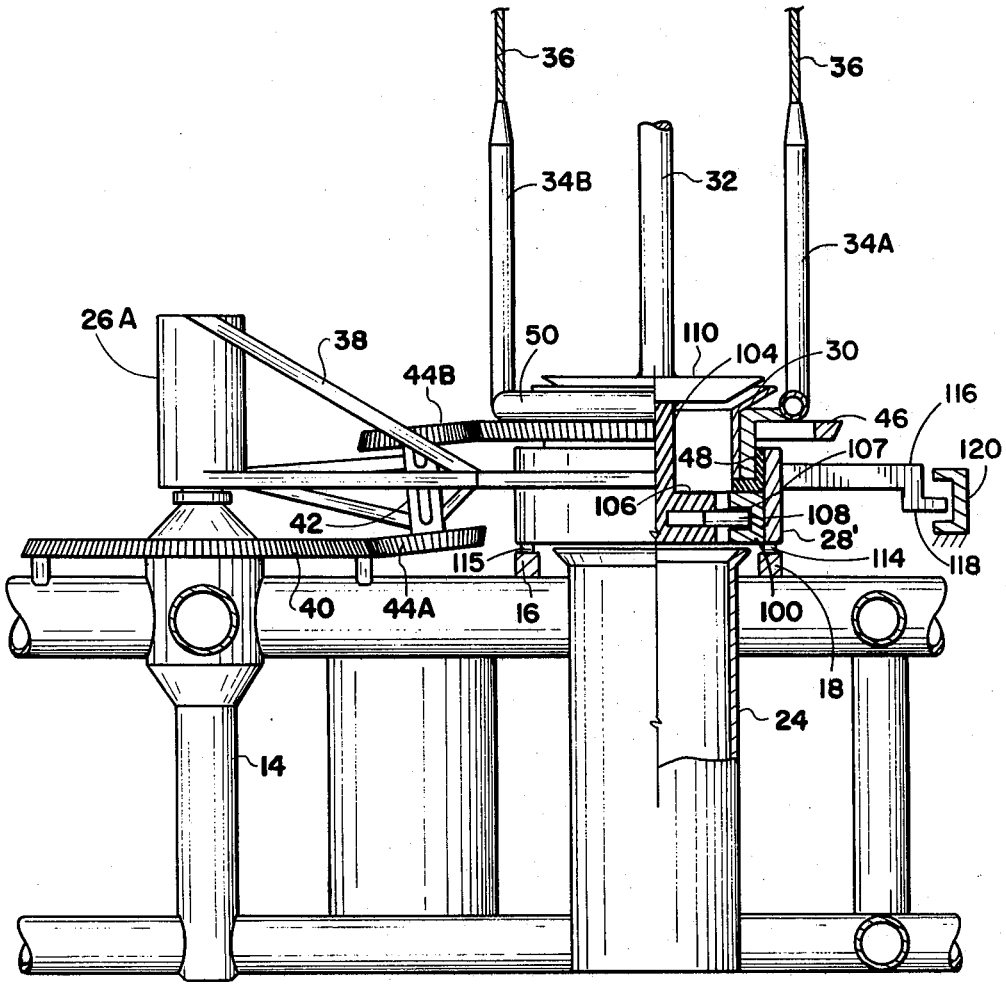
FIG. 5 illustrates still another embodiment of the invention.
Figure 7:
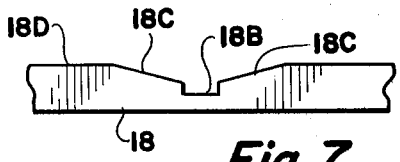
FIGS. 6 and 7 illustrate details of FIG. 5.

In FIG. 5 is shown an improved embodiment over FIG. 3, which avoids the difficulty of wrapping the guide cables around the drill pipe if the carousel is rotated more than 180°.

Basically in FIG. 5 the carousel 26A, 38 and 28 is still utilized to provide a platform for supporting the guide posts and guide cables, and providing a short well slot so as to guide the bit through the well slot 30 into one of the permanent well slots 24 of the carousel guide frame 10 of FIG. 1, which rests on the sea floor. FIG. 5 is a schematic drawing of the essential parts of FIG. 3 plus additional parts which are involved in this improvement. The support platform 28' is still utilized, and is a part of the revolving structure. However, this embodiment does not have the receptacle 54 for the purpose of rotating the revolving structure by means of the drill pipe. The cylindrical portion 26A is still utilized as a bearing to permit the carousel to revolve about the central post 14, so as to maintain the path of the support platform is a circular form. The basic support for the support platform are the circular tracks 16 and 18.

Figure 6:
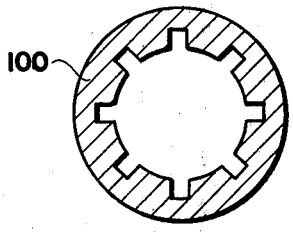

Instead of using the drill pipe 32 with the fixture 52 in cooperation with a receptacle 54, the drill pipe shown in FIG. 5 having a lower end 104, carries a fixture 106 on the bottom end with a plurality of radial dogs or pins 108 that can be retracted into the body of the fixture 106. The fixture 106 is lowered by the drill pipe 32 until the spacer 110 rests in the upper well slot 30. When the drill pipe is seated, the fixture 106 will be aligned with a circular indexing means 100 (FIG. 6) which is positioned in and concentric with the cylindrical portion 28' of the support platform. The indexing means 100 then serves to position the fixture 106 so that each of the four dogs, or pins, 108 can be extended radially out from the fixture 106, to be seated into appropriate notches in the wall of the support platform 28'.

When the drill pipe is lowered and the fixture 106 is securely locked by means of the dogs into the openings 107, then by means of the drill pipe the support platform is lifted, and by means of the support arms 38 the bearing portion 26A is lifted, and by rotation of the drill pipe the revolving structure is swung in one direction or the other to a new position over a different well slot.

In FIG. 5 is shown a short stub or leg 114 which is used to index the support platform on the top of the track 18. There are a plurality of notches 18B, with sloping surfaces 18C utilized as guides for indexing or positioning the support platform 28', so that the leg 114 is centered in the index socket 18B. On the track 18 there is one of these indexing sockets in 18B corresponding to each of the individual well slots 24 so that when the leg 114 is in the slot 18B the carousel is concentric with a selected well slot.

An arm 116 extends out from the body of the support platform 18', and has a protruding finger 118 which moves inside channel 120 which is fixed to the carousel guide frame 10. The height of the channel is such as to provide sufficient movement of the support platform up and down so that when it is in the down position the leg 114 will be above the top surface 18D of the track. Thus by inserting the drill pipe with the fixture 106 into the well slot 30 of the carousel and attaching the dogs 108 into the wall of the support platform 28', the carousel can be lifted sufficiently to remove the leg 114 from the notch 18B. Rotation of the drill pipe then will cause the carousel to revolve about the central post until the support platform 28 approaches the position of the desired well slot. The carousel is then lowered so that the leg 114 will slide along the top 18D of the track 18 until the leg fits into the socket 18B. The fixture is then released from the carousel and withdrawn to the surface in preparation for attaching the drill bit, etc.

It will be clearly seen that here as in FIG. 3, when the carousel revolves, guide cables 36 remain in the same azimuth, no matter which direction the carousel moves. Furthermore, since in the process of rotating the carousel, the drill pipe is centered along the axis of the support platform and no matter how many revolutions of the carousel take place there will be no opportunity for the cables 36 to wrap around the drill pipe in any way. While the invention comprising the method of maintaining a constant azimuth of the guide cables 36 is the important part of this invention and can be used without the second portion which concerns the method of moving the carousel, it is clear that the combination of both of these features makes a far more satisfactory system of drilling using both of the carousel improvements.

While we have illustrated the well slot platform 50 as having four guide posts and four cables, arranged in the corners of a square, any number of guide posts can, of course, be used, such as three or more.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. A subsea drilling system with which a plurality of wells are drilled and maintained from a floating platform, said subsea drilling system comprising:

(a) a guide frame having a guide track positioned on the sea floor and having a plurality of guide frame well slots and including a vertical turning post having an axis within the plurality of well slots;

(b) a carousel structure movably supported on said guide frame for movement along said guide track;

(c) a well slot platform with a well slot, said well slot platform being supported from said carousel structure to permit rotation about the axis of said well slot;

(d) means to position said platform well slot successively over each of said guide frame well slots and to rotate said well slot platform about the axis of said well slot as a function of the movement of said structure along a path defined by said guide frame well slots.

2. A subsea drilling system with which a plurality of wells can be drilled from a floating platform comprising:

(a) a guide frame positioned on the sea floor, and having a plurality of guide frame well slots arranged in a circular array, and including a vertical turning post at the axis of the array of well slots;

(b) a movable carousel structure supported on said guide frame and means to guide said carousel structure to revolve about said turning post;

(c) a guide post platform having a single well slot and rotatably supported by said carousel structure;

(d) a plurality of guide posts supported from said guide post platform;

(e) each of said guide posts attached to one of a plurality of guide cables supported at said platform in a horizontal pattern and azimuthly positioned similar to the pattern of said support posts;

(f) means to control the azimuthal orientation of said guide post platform whereby when said carousel structure revolves through a given angle about said turning post, said guide post platform will rotate with respect to the axis of said single well slot to an equal angle in the opposite direction whereby the absolute azimuthal orientation of said guide post platform remains constant as the carousel structure revolves.

3. The improvement in the drilling system as in claim 2 in which said means to control the azimuthal rotation of said guide post platform comprises:

(a) first and second gears of equal diameter;

(b) said first gear supported from said guide frame in a coaxial relation with said vertical turning post;

(c) said second gear mounted to, and concentric with, said rotatable guide post platform on said carousel; and (d) a pinion gear journaled to the carousel frame and meshing with both said first gear and said second gear, the gear ratio such that azimuthal orientation of said guide posts will remain constant.

4. The improvement in the drilling system as in claim 1 in which said means to position said well slot platform comprises:

(a) first and second chain sprockets of equal diameter and number of teeth;

(b) said first chain sprocket mounted rigidly to said guide frame, coaxial with said turning post;

(c) said second sprocket mounted to and concentric with said rotatable guide post platform on said carousel structure; and (d) a chain around said first and second sprockets.

5. The drilling carousel as in claim 2 in which the number of guide posts is four, arranged in the corners of a square concentric with said carousel well slot.

6. In a subsea drilling system with which a plurality of wells using a drill pipe are drilled and maintained from a floating platform, in which said subsea drilling system includes at least:

(a) a guide frame positioned on the sea floor and having a plurality of guide frame well slots;

(b) a carousel structure movably supported on said guide frame; and (c) a revolvable platform supported by said carousel structure and having a single well slot;

(d) means to position said well slot of said revolvable platform successively over each of said guide frame well slots, said means comprising:

(1) a fixture for attachment to the bottom end of said drill pipe, said fixture including a plurality of radially spaced pins;

(2) a receptacle supported by said platform concentric with said single well slot, having means to accept and lock to said pins of said fixture; and (3) means to align selectively said single well slot over the position of each of the well slots of said guide frame including a plurality of index notches supported by said guide frame for receiving said pins.

7. A subsea drilling system with which a plurality of wells are drilled and maintained from a floating vessel comprising:

(a) a template guide frame means positioned on the sea floor and having a plurality of template well slots in a fixed pattern;

(b) a guide frame having a revolvable single well slot platform.

(c) means to move said guide frame along said pattern;

(d) means to position said single well slot platform successively over each of said template well slots including:

(1) a fixture for attachment to the bottom of a drill pipe and having a plurality of radially spaced rods;

(2) a receptacle on said single well slot platform having means to accept and lock to said rods of said fixture;

(3) means to align said single well slot platform over each template well slot.

8. A system as defined in claim 7 in which said template well slots are arranged in a circular pattern and means to rotate said single well slot platform as a function of said movement along said circular pattern.

* * * * *